US010711430B2

(12) United States Patent
Björe Dahl

(10) Patent No.: US 10,711,430 B2
(45) Date of Patent: Jul. 14, 2020

(54) CONTROL UNIT IN WORKING MACHINE FOR IDENTIFYING HUMAN OPERATION OF IMPLEMENT

(71) Applicant: CPAC SYSTEMS AB, Gothenburg (SE)

(72) Inventor: Per Björe Dahl, Gothenburg (SE)

(73) Assignee: CPAC SYSTEMS AB, Gothenburg (SE)

( * ) Notice: Subject to any disclaimer, the term of this patent is extended or adjusted under 35 U.S.C. 154(b) by 0 days.

(21) Appl. No.: 16/094,020

(22) PCT Filed: Apr. 19, 2016

(86) PCT No.: PCT/SE2016/050339
§ 371 (c)(1),
(2) Date: Oct. 16, 2018

(87) PCT Pub. No.: WO2017/184038
PCT Pub. Date: Oct. 26, 2017

(65) Prior Publication Data

US 2019/0119880 A1 Apr. 25, 2019

(51) Int. Cl.
*E02F 3/43* (2006.01)
*E02F 9/20* (2006.01)
(Continued)

(52) U.S. Cl.
CPC ..... *E02F 3/435* (2013.01); *E02F 9/2025* (2013.01); *E02F 9/264* (2013.01); *E02F 3/32* (2013.01)

(58) Field of Classification Search
CPC ..... E02F 3/435; E02F 9/2025; E02F 9/264; E02F 3/32
(Continued)

(56) References Cited

U.S. PATENT DOCUMENTS 5,383,532 A 1/1995 Shonai et al.
5,941,921 A 8/1999 Dasys et al.
(Continued)

FOREIGN PATENT DOCUMENTS

EP 1914353 A2 4/2008
EP 2805858 A1 11/2014
(Continued)

OTHER PUBLICATIONS

International Search Report (dated Feb. 15, 2017) for corresponding International App; PCT/SE2131C/00339.
(Continued)

*Primary Examiner* — Gertrude Arthur Jeanglaude
(74) *Attorney, Agent, or Firm* — Sage Patent Group

(57) ABSTRACT

A control unit is provided for a working machine. The working machine includes an implement and a main body. The implement is movable relative to the main body. The working machine further includes a control entity adapted to be activated upon receipt of an action initiating signal. The control unit is adapted to identify that a human operator of the working machine actively operates the implement relative to the main body towards a reference surface until the implement contacts the reference surface, thereby identifying a human operator input signal, and upon identification of the operator input signal, issue the action initiating signal to the control entity.

18 Claims, 6 Drawing Sheets

(51) Int. Cl.
*E02F 9/26* (2006.01)
*E02F 3/32* (2006.01)

(58) Field of Classification Search
USPC ..... 701/50
See application file for complete search history.

(56) References Cited

U.S. PATENT DOCUMENTS

| | | | | |
|---|---|---|---|---|
| 6,064,933 | A | 5/2000 | Rocke | |
| 2004/0020084 | A1 | 2/2004 | Riberon et al. | |
| 2013/0129460 | A1 | 5/2013 | Cabibulayev | |
| 2014/0067092 | A1 | 3/2014 | Cesur et al. | |
| 2015/0240453 | A1* | 8/2015 | Jaliwala | E02F 9/2041 701/50 |
| 2015/0308082 | A1 | 10/2015 | Takaura et al. | |
| 2016/0312434 | A1* | 10/2016 | Shintani | E02F 9/262 |

FOREIGN PATENT DOCUMENTS

| | | | |
|---|---|---|---|
| EP | 3159455 | A1 | 4/2017 |
| WO | 2007097862 | A1 | 8/2007 |
| WO | 2015194601 | A1 | 12/2015 |

OTHER PUBLICATIONS

Extended European Search Report dated Dec. 20, 2019 for European Application No. 16899590.0, 8 pages.

* cited by examiner

CONTROL UNIT IN WORKING MACHINE FOR IDENTIFYING HUMAN OPERATION OF IMPLEMENT

BACKGROUND AND SUMMARY

The present invention relates to a control unit. Further, the present invention relates to a control system and a working machine. Moreover, the present invention relates to a method for issuing an action initiating signal.

In a working machine, a human operator generally has the possibility to control various functions of the working machine by using one or more of a plurality of operating means. For instance, such operating means may comprise one or more of the following controls: levers, pedals, switches, buttons and touch screens.

However, for at least certain operating conditions, the operation of the controls may result in an undesired working environment for the operator, for instance from an ergonomic and/or a mental work load point of view.

In view of the above, it is desirable to simplify the way in which a working machine operator can control at least one function of a working machine.

As such, an aspect of the present invention relates to a control unit for a working machine. The working machine comprises an implement and a main body. The implement is movable relative to the main body. Moreover, the working machine comprises a control entity adapted to be activated upon receipt of an action initiating signal.

According to an aspect of the present invention, the control unit is adapted to:

identify that a human operator of the working machine actively operates the implement relative to the main body towards a reference surface until the implement contacts the reference surface, thereby identifying a human operator input signal, and upon identification of the operator input signal, issue the action initiating signal to the control entity.

The control unit in accordance with an aspect of the present invention implies that the operator who is currently operating an implement can trigger an action initiating signal using the movements of the implement. As such, the operator need not actuate a separate control in order to trigger the action initiating signal but may for instance simply keep his/hers hand on the control(s) controlling the movements of the implement while initiating the action initiating signal. Thus, by virtue of the control unit in accordance with an aspect of the present invention, a safe control of one or more functions of the working machine is envisioned.

Optionally, the control unit is adapted to receive a confirmation request. The confirmation request is preferably a question asked to the operator of the working machine. The control unit is adapted to issue the action initiating signal upon identification of an affirmative operator input signal as a response to the confirmation request.

When operating a working machine, a human operator may encounter one or more confirmation requests such as "Do you want to proceed?" or "Do you want to store data?". Rather than operating a separate control in order to confirm or decline such a request, using the above control unit, the operator may confirm and/or decline the request by operating the implement. For instance, the operator may confirm the request by operating the implement so as to move until it contacts a reference surface to thereby issue an action initiating signal.

Optionally, the working machine comprises a contact detecting arrangement for determining that the implement contacts the reference surface. The control unit is adapted to receive a contact signal from the contact detecting arrangement indicative of that the implement contacts the reference surface.

A contact detecting arrangement implies an appropriate means for determining that the implement contacts the reference surface.

Optionally, the contact detecting arrangement comprises a force determining means adapted to determine a force applied to the implement. The control unit being adapted to, determine a contact force value indicative of a contact force between the reference surface and the implement using the force determining means, and determine that said implement contacts said reference surface for a contact force value being within a predetermined contact force value range.

The use of a force determining means implies that implement contact may be determined in many different conditions. For instance, the force determining means implies that implement contact may be determined even if for instance visual conditions around the implement do not allow implement contact determination using visual means.

Optionally, the control unit is further adapted to identify that a human operator of the working machine, subsequent to an established contact between the implement and the reference plane, actively operates the implement away from the reference surface such that the contact between the implement and the reference surface ceases. Thus, the control unit may be adapted to detect that the operator actively only taps the implement against the reference surface to thereby issue an input signal.

Optionally, the control unit is adapted to determine a contact time during which the implement contacts the reference surface before the contact ceases.

Using a contact time may be an appropriate means for determining that a human operator intentionally taps the implement against the reference surface in order to trigger an action initiating signal.

Optionally, the control unit is adapted to issue the action initiating signal to the control entity only if the contact time is within a predetermined tap time range.

Optionally, the action initiating signal comprises a request to the control entity to determine a current position of the implement.

A working machine implement may be used for determining a position of a location adjacent to the working machine. By virtue of the above control unit, the operator does not need to actuate any separate control for determining and possibly also storing the current position of the implement. Instead, the implement's current position may be stored when the operator controls the implement so as to contact the reference surface.

Optionally, the action initiating signal comprises a request to the control entity to determine a distance between the current position and a previously stored reference position of the implement.

The above implementation implies that the operator may determine the distance between two locations, e.g. two locations adjacent to the working machine, without having to actuate a separate control. Instead, the operator can determine the distance by operating the implement only.

A second aspect of the present invention relates to a control system for a working machine. The control system comprises a control unit according to a first aspect of the present invention and a control entity. The control unit is adapted to communicate with the control entity.

A third aspect of the present invention relates to a working machine comprising a control unit according to the first aspect of the present invention and/or a control system according to the second aspect of the present invention.

A fourth aspect of the present invention relates to a method for issuing an action initiating signal to a control entity of a working machine. The working machine comprises an implement and a main body. The implement is movable relative to the main body and the control entity is adapted to be activated upon receipt of the action initiating signal.

According to the fourth aspect of the present invention, the method comprises:

identifying that a human operator of the working machine actively operates the implement relative to the main body towards a reference surface until the implement contacts the reference surface, thereby identifying the operator input signal, and upon identification of the operator input signal, issuing the action initiating signal to the control entity.

Optionally, the method further comprises receiving a confirmation request. The confirmation request is preferably a question asked to the operator of the working machine. The method may comprise issuing the action initiating signal upon identification of an affirmative operator input signal as a response to the confirmation request.

Optionally, the working machine comprises a contact detecting arrangement for determining that the implement contacts the reference surface. Moreover, the method comprises receiving a contact signal from the contact detecting arrangement indicative of that the implement contacts the reference surface.

Optionally, the contact detecting arrangement comprises a force determining means adapted to determine a force applied to the implement, the method comprises:

determining a contact force value indicative of a contact force between the reference surface and the implement using the force determining means, and determining that the implement contacts the reference surface for a contact force value being within a predetermined contact force value range.

Optionally, the method further comprises identifying that a human operator of the working machine, subsequent to an established contact between the implement and the reference plane, actively operates the implement away from the reference plane such that the contact ceases.

Optionally, the method further comprises determining the contact time during which the implement contacts the reference surface before the contact ceases.

Optionally, the method comprises issuing the action initiating signal to the control entity if the contact time is within a predetermined tap time range.

Optionally, the method further comprises determining the current position of the implement, the action initiating signal comprises a request to the control entity to determine the current position of the implement.

Optionally, the action initiating signal comprises a request to the control entity to determine the distance between the current position and a previously stored reference position of the implement.

BRIEF DESCRIPTION OF THE DRAWINGS

With reference to the appended drawings, below follows a more detailed description of embodiments of the invention cited as examples.

In the drawings.

It should be noted that the appended drawings are not necessarily drawn to scale and that the dimensions of some features of the present invention may have been exaggerated for the sake of clarity.

DETAILED DESCRIPTION

The invention will be described in the following for a working machine 10 in the form of an excavator such as the one illustrated in FIG. 1. The excavator 10 should be seen as an example of a working machine which could comprise a control unit and/or a working machine control system according to the present invention and/or for which a method according to the present invention could be carried out.

Figure 1:
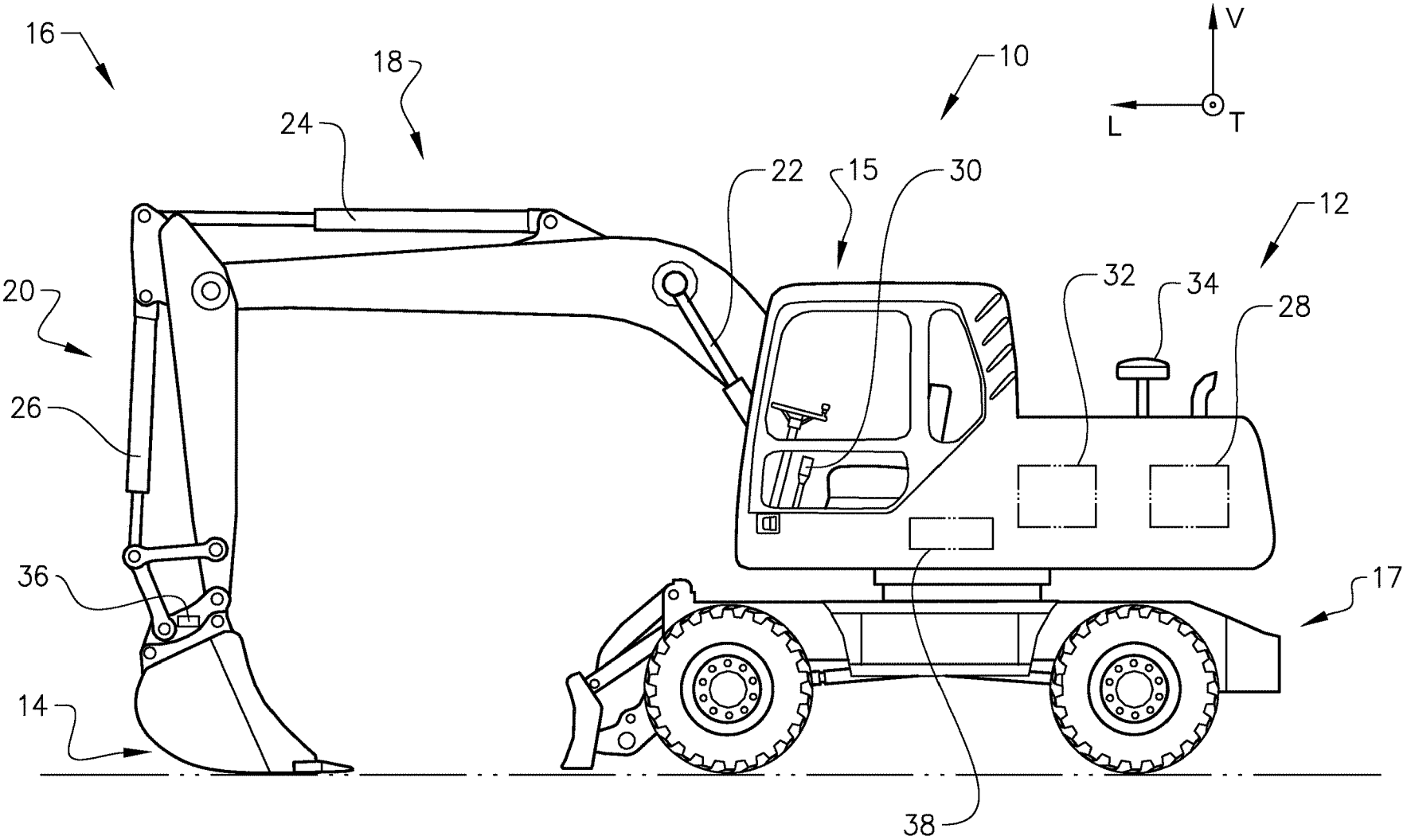
FIG. 1 is a schematic side view of a working machine.

The FIG. 1 working machine 10 comprises a main body 12, an implement 14 and a connector 16 connecting the implement 14 to the main body 12. Generally, the main body 12 comprises a human operator cabin 15. Moreover, as is indicated in FIG. 1, the main body 12 may comprise a propulsion unit 17 for propelling the working machine 10.

As a non-limiting example, the working machine 10 may be constituted by the main body 12, the implement 14 and the connector 16. In such an example, the main body 12 is constituted by the whole working machine except for the implement 14 and the connector 16.

The implement 14 is movable relative to the main body 12. In FIG. 1, the connector 16 comprises a boom 18 and an arm 20. It should be noted that other working machines may comprise a connector with more or fewer components. For instance, it is envisaged that certain working machines, such as a wheeled excavator, may comprise a first boom (not shown) pivotally connected to the main body, a second boom (not shown) pivotally connected to the first boom and an arm pivotally connected to the second boom.

Purely by way of example, and as is indicated in FIG. 1, the implement 14 may be a bucket.

The main body 12 has a vertical extension in a vertical direction V. Moreover, and as is indicated in FIG. 1, the main body 12 also has an extension in a longitudinal dimension L in the intended drive direction of the working machine 10 and an extension in a transversal dimension T being perpendicular to each one of the vertical and longitudinal dimensions V, L.

Purely by way of example, and as is illustrated in FIG. 1, the boom 18 may be pivotally connected to the main body 12 and may be actuated by a boom actuator 22 connected to each one of the main body 12 and the boom 18. In a similar vein, the arm 20 may be pivotally connected to the boom 18 and may be actuated by an arm actuator 24 connected to each one of the boom 18 and the arm 20. Purely by way of example, at least one, alternatively both, of the boom actuator 22 and the arm actuator 24 may comprise a hydraulic cylinder, such as a double acting hydraulic cylinder. Additionally, the implement 14 may be moveable relative to the arm 20 by means of an implement actuator 26, e.g. a hydraulic implement actuator 26. For instance, the implement 14 may be pivotable relative to the arm 20.

The FIG. 1 working machine 10 further comprises a control unit 28. The FIG. 1 control unit 28 is exemplified as an electronic control unit that may be adapted to control working machine operations and/or to process data relevant for the operation of the working machine 10. As non-limiting and non-exhaustive examples, the feature "processing data" may include one or more of: determining, storing, transmitting or receiving data.

Purely by way of example, the control unit 28 may comprise a computer program comprising program code means for performing the computing steps of any one of the methods that will be presented hereinbelow. For instance, the control unit 28 may comprise a computer readable medium carrying a computer program comprising program code means for performing the computing steps of any one of the methods that will be presented hereinbelow.

Moreover, as is indicated in FIG. 1, the working machine comprises a control device 30 for controlling the movement of the implement 14 relative to the main body 12. In FIG. 1, the control device 30 is exemplified by a lever. However, it is envisioned that other implementations of the working machine may comprise another type of an implement control device such as a pedal, switch, button and touch screen (not shown in FIG. 1).

Irrespective of the implementation of the control device 30, a human operator of the working machine 10 can control the movement of the implement 14 relative to the main body 12 by operating the control device 30.

Furthermore, the working machine 10 comprises a control entity 32 adapted to be activated upon receipt of an action initiating signal. For the purpose of simplifying the description of the present invention, the control entity 32 is in FIG. 1 illustrated as being separate from the control unit 28 and the control unit 28 is adapted to communicate with the control entity 32, for instance using a wire based or a wireless communication means (not shown in FIG. 1). However, it is also contemplated that the control entity 32 may form part of the control unit 28. Purely by way of example, if the control unit 28 is an electronic control unit 28 comprising a computer program, the control entity 32 may comprise one or more functionalities (e.g. implemented by subroutines, classes or the like) of the computer program.

Traditionally, the above-mentioned action initiating signal has been issued in response to a dedicated action made by a human operator. For instance, the operator may actuate a separate control device such as a button, touch screen or the like in order to ensure that the action initiating signal is issued to the control entity 32.

Figure 2:
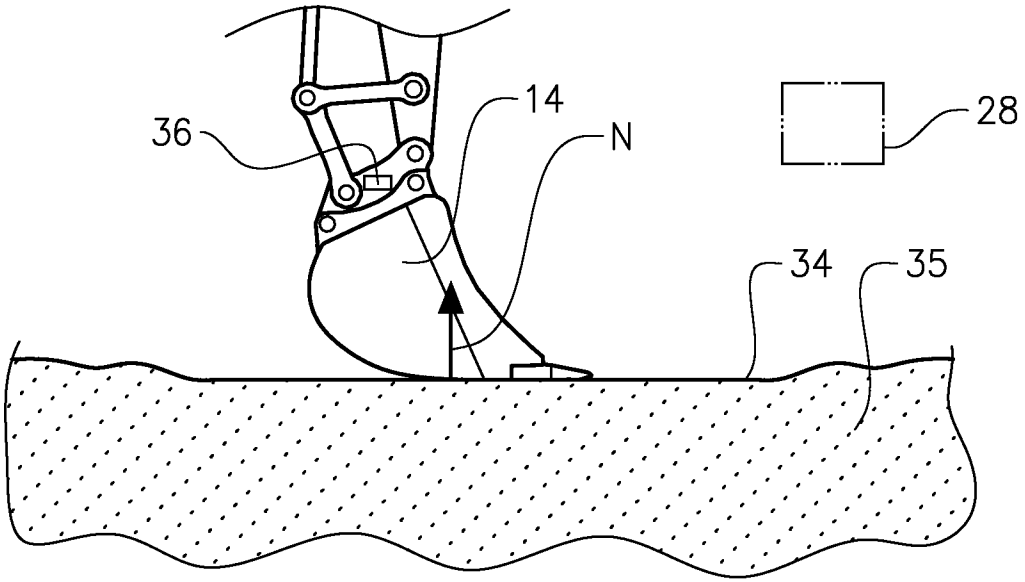
FIG. 2 schematically illustrates a procedure that can be carried out by an embodiment of the control unit according to the first aspect of the present invention.
Figure 2:
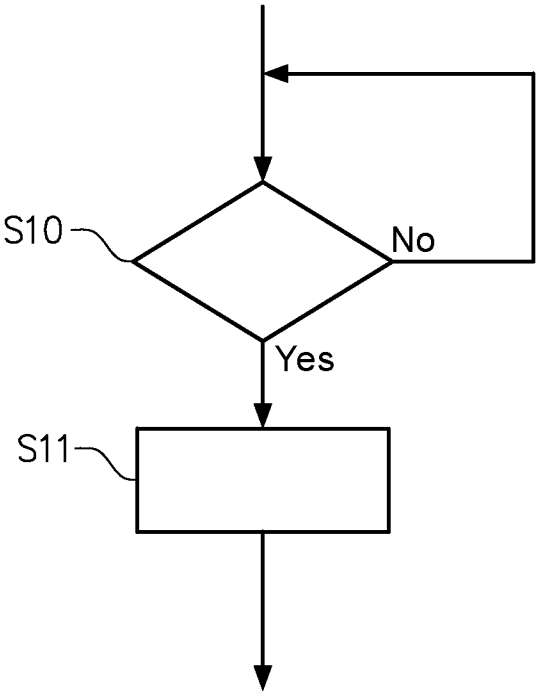

However, with reference to FIG. 2, the control unit 28 according to the present invention is adapted to:

identify that a human operator of the working machine 10 actively operates the implement 14 relative to the main body 12 towards a reference surface 34 until the implement 14 contacts the reference surface 34, thereby identifying a human operator input signal, and upon identification of the operator input signal, issue the action initiating signal to the control entity 32.

As may be gleaned from the above, in step S10 it is identified that the operator actively operates the implement towards the reference surface 34. Moreover, it is identified that the operator actively operates the implement 14 until contact with the reference surface has been obtained.

Purely by way of example, different control entities 32 may be adapted to perform different operations once activated upon receipt of an action initiating signal. Moreover, though again purely by way of example, a control entity 32 may be adapted to perform different operations once activated upon receipt of an action initiating signal and which operation to perform may depend on the current operation situation of the working machine 10.

Purely by way of example, the control entity 32 may be adapted to determine and/or store one or more positions, for instance a current position, of a portion, such as the implement 14, of the working machine 10. As another non-limiting example, the control entity 32 may be adapted perform calculations, such as calculations involving determined and/or stored positions of a portion of the working machine 10. As a further example, the control entity 32 may be adapted to determine and/or store settings of the working machine 10.

The reference surface 34 may be any surface that the implement 14 may contact. In the example presented in FIG. 2, the reference surface 34 is the surface of the ground 35 onto which the working machine is resting. However, the reference surface 34 may be any other type of surface, for instance a surface of the working machine 10 or a surface of any other object (not shown). Moreover, although the FIG. 2 reference surface substantially extends in a horizontal plane, it is envisioned that the reference surface may extend in other directions. Further, the reference surface 34 need not be a planar surface but can assume any other type of shape.

Figure 3:
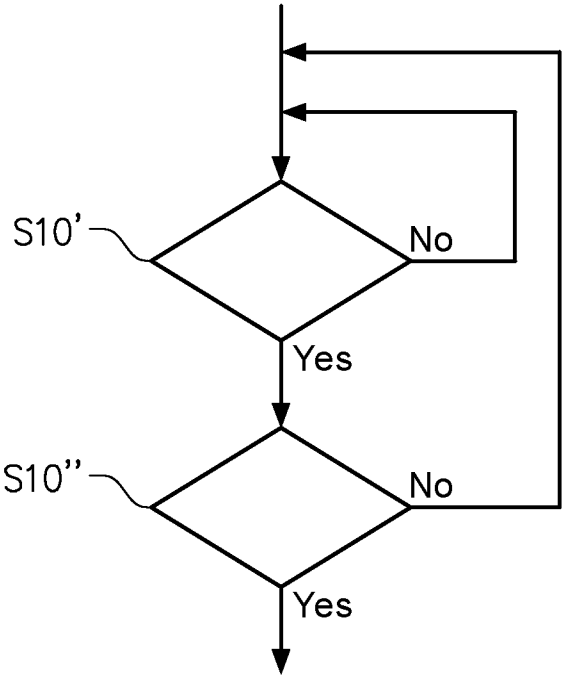
FIG. 3 schematically illustrates a procedure that can be carried out by an embodiment of the control unit according to the first aspect of the present invention.

With reference to FIG. 3, step S10 may be performed in two or more sub-steps that may be executed in sequence or in parallel. Purely by way of example, step S10 may comprise a first sub-step S10' and a second sub-step S10".

The first sub-step S10' may identify that it is the operator that moves the implement 14, i.e. in the first sub-step S10' it is verified that the implement 14 is not automatically moved, and the second sub-step S10" may identify that the implement 14 contacts the reference surface 34. As such, again with reference to FIG. 3, a check whether or not reference surface contact is obtained is only performed when it has been determined that the operator actively operates the implement 14.

It is also envisaged that the first sub-step S10' may identify that the implement 14 contacts the reference surface 34 that and the second step S10" may identify that it is the operator who moves the implement 14. In such a configuration, a check whether or not the operator currently actively operates the implement 14 is only performed when it has been determined that reference surface contact has been obtained.

Irrespective of how step 10 is implemented, identifying that a human operator of the working machine 10 actively operates the implement 14 relative to the main body 12 may be performed by determining that implement operating signals are transmitted from the control device 30.

Figure 4:
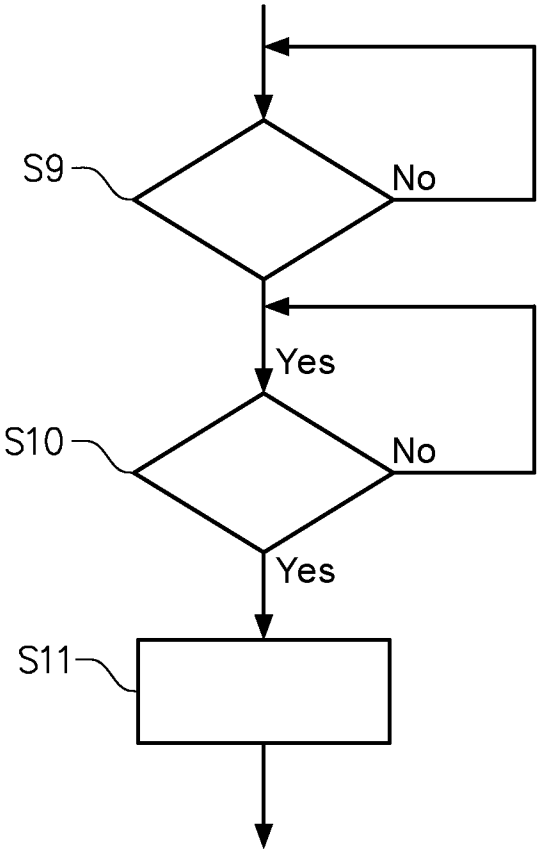
FIG. 4 schematically illustrates a procedure that can be carried out by an embodiment of the control unit according to the first aspect of the present invention.

With reference to FIG. 4, the control unit 28 may be adapted to receive a confirmation request S9. Purely by way of example, a confirmation request may be issued from another control unit or control entity (not shown) for instance another control unit or a control entity hosted by the working machine. However, it is also envisaged that the control unit 28 itself may be adapted to issue the confirmation request.

As a non-limiting example, the confirmation request may be a question asked to the operator. Purely by way of example, the question may be presented to the user using a presentation means (not shown) such as a display, loudspeaker and/or a tactile presentation arrangement (not shown).

For the purpose of presenting examples only, the question asked to the operator may be of the type "Do you want to continue?", "Do you want to quit?" or "Do you want to save?".

Irrespective of how the confirmation request is issued and irrespective of whether or not a question is the confirmation request, the control unit 28 may be adapted to issue the action initiating signal upon identification of an affirmative operator input signal as a response to the confirmation request. This is what is illustrated in FIG. 4 wherein the receipt of the confirmation request is indicated by S9.

The operator may respond to any one of the above questions by issuing the action initiating signal. For instance, the operator may answer in the affirmative by issuing the action initiating signal. In other words, the control unit 28 may be adapted to identify a certain (active) measure taken by the operator, viz that the human operator of the working machine 10 actively operates the implement 14 relative to the main body 12 towards a reference surface 34 until the implement 14 contacts the reference surface 34, as an affirmative operator input signal.

Moreover, the operator may answer in the negative by not issuing the action initiating signal. As such, the control unit 28 may be adapted to identify another (passive) measure taken by the operator, viz that the human operator of the working machine 10 does not operate the implement 14 relative to the main body 12 towards a reference surface 34 until the implement 14 contacts the reference surface 34, as an negative operator input signal.

Put differently, the control unit 28 may be adapted to issue the action initiating signal when receiving an operator response to the confirmation request. Optionally, the control unit 28 may be adapted not to issue the action initiating signal when not receiving an operator response to the confirmation request. If no operator response is received, the control unit 28 may be adapted to issue another type of signal, such as a signal indicative of a negative response to the confirmation request.

However, it is also envisioned that the operator may use the implement to actively decide between answering in the affirmative of the negative. Such an implementation is presented hereinbelow.

In embodiments of the invention, the working machine 10 may comprise a contact detecting arrangement for determining that the implement 14 contacts the reference surface 34. The control unit 28 may adapted to receive a contact signal from the contact detecting arrangement indicative of that the implement contacts the reference surface.

The contact detecting arrangement may be implemented in a plurality of different ways. For instance, the contact detecting may comprise a visual sensor (not shown), such as camera, laser sensor or the like, which may be adapted to determine a gap between the implement 14 and the reference surface 34. When the thus determined gap is below a predetermined threshold value, for instance when the gap is close to zero, implement contact is determined.

As another non-limiting example, the working machine may comprise a distance determining arrangement. Purely by way of example, such a distance determining arrangement may comprise a RADAR or LIDAR arrangement and the distance determining arrangement may be connected to the implement 14 for determining the distance between the implement 14 and the reference surface 34. When the thus determined distance is smaller than a predetermined threshold value, for instance when the distance is close to zero, implement contact is determined.

FIG. 1 working machine 10 comprises preferred embodiment of the contact detecting arrangement 36. To this end, in FIG. 1, the contact detecting arrangement 36 is implemented as a force determining means 36 adapted to determine a force applied to the implement 14. In the FIG. 1 embodiment, the force determining means is implemented as an implement load sensor adapted to determine the load of the implement 14. However, it is also envisaged that the contact detecting arrangement 36 may comprise another type of sensor.

As non-limiting examples, the contact detecting arrangement 36 may comprise one of the following types of sensors: an acceleration sensor that detects the acceleration of the implement 14 and from the acceleration thus detected determines a force applied to the implement 14; a pressure sensor, and an electrical power sensor. The pressure sensor may for instance be a hydraulic pressure sensor adapted to detect a pressure in a portion of the hydraulic system, such as one of the actuators 22, 24, 26. Optionally, the pressure sensor may be a contact pressure sensor adapted to detect a contact pressure between the implement 14 and the reference surface.

In the FIG. 1 embodiment, the force determining means 36 is located between the implement 14 and the connector 16, e.g. between the implement 14 and the arm 20. However, it is also envisaged that the force determining means 28 may be located in another position such as the implement 14, e.g. in an implementation of the force determining means 28 which comprises a pressure sensor. Further, embodiments are also envisaged in which the force determining means 28 is located on one of the above discussed actuators 22, 24, 26 or in any of the hydraulic circuits (not shown) connected to the actuators 22, 24, 26.

Figure 5:
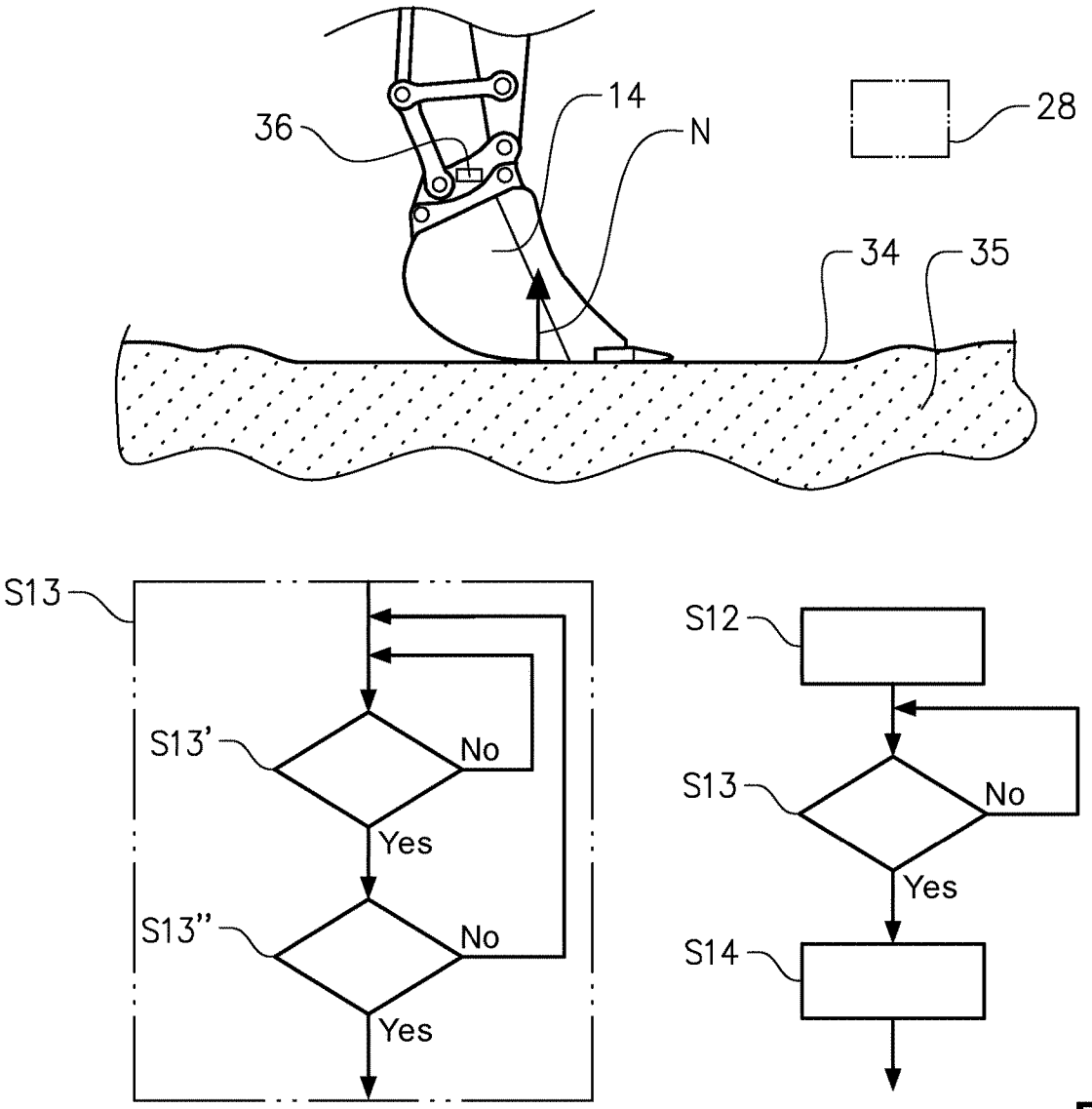
FIG. 5 schematically illustrates a procedure that can be carried out by an embodiment of the control unit according to the first aspect of the present invention.

With reference to FIG. 5, the control unit 28 may be adapted to:

determine a contact force value indicative of a contact force N between the reference surface 34 and the implement 14 using the force determining means 36, and determine that the implement 14 contacts the reference surface 34 for a contact force value being within a predetermined contact force value range.

Step S13 may be performed in a single step. However, as is indicated in FIG. 5, step S13 may also be performed in two or more sub-steps S13', S13". Purely by way of example, the sub-steps S13', S13" may be arranged in accordance with the following:

S13' determine that the contact force value is within a predetermined contact force value range, and S13" if it is determined that the contact force value is within the predetermined contact force value range, determine that the implement 14 contacts the reference surface.

The predetermined contact force value range may be an open range or a closed range. Purely by way of example, an end point of the predetermined contact force value range may be indicative of the weight Wi of the implement 14. In such an implementation, the range may be formulated in accordance with the following: $Wi \leq N < \infty$. It is also envisaged that other embodiments of the above discussed method may comprise other types of ranges, such as $f1 \times Wi \leq N \leq f2 \times Wi$ wherein f1 and 12 are range factors. Purely by way of example, the first range factor f1 may be within the range of $0 < f1 \leq 1$ and the second range factor f2 may be substantially larger than 1. Although the above discussed range $f1 \times Wi \leq N \leq f2 \times Wi$ has been presented as a closed range, it is also envisaged that at least one of the ends may be open.

As has been intimated hereinabove, the force determining means 36 may be implemented as an implement load sensor adapted to determine the load of the implement 14. Such a load sensor may be used for determining the contact force value N indicative of the contact force between the reference surface 34 and the implement 14.

For instance, the implement load sensor may be used such that a determined implement load equal to or less than zero is indicative of that the contact force value N is within a predetermined contact force value range. In such a condition, the normal force imparted on the implement 14 exceeds the weight of the implement 14 and any possible load (not shown) present in the implement.

Furthermore, the control unit 28 may be adapted to identify that a human operator of the working machine 10, subsequent to an established contact between the implement 14 and the reference plane 34, actively operates the implement 14 away from the reference plane 34 such that the contact ceases. For instance, the control unit 28 may be adapted to determine a contact time during which the implement 14 contacts the reference surface 32 before the contact ceases.

Figure 6:
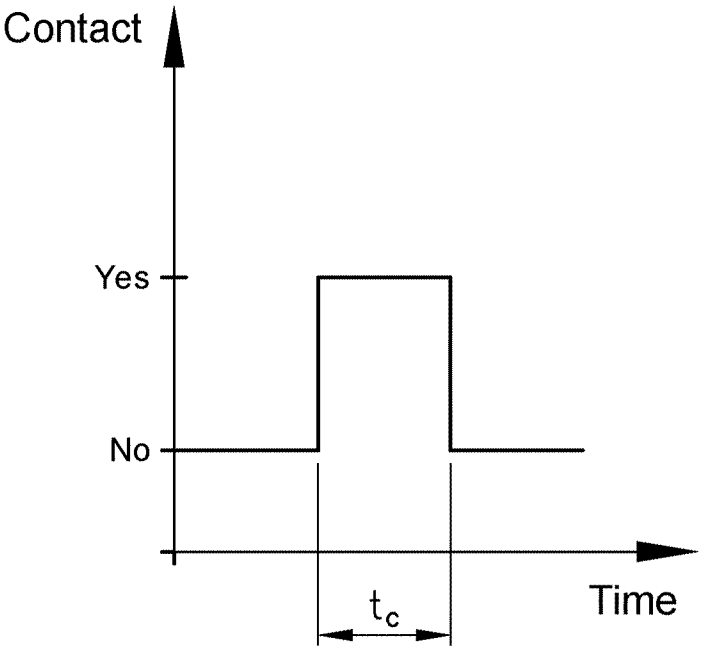
FIG. 6 schematically illustrates a procedure that can be carried out by an embodiment of the control unit according to the first aspect of the present invention.

An example of the above implementation is illustrated in FIG. 6, wherein the control unit 28 is adapted to determine the contact time tc during which the implement 14 contacts the reference plane 34. Purely by way of example, the control unit 28 may be adapted to issue the action initiating signal to the control entity only if the contact time tc is within a predetermined tap time range.

As for the above discussed contact force value range, the predetermined tap time range may be an open range or a closed range.

Figure 7:
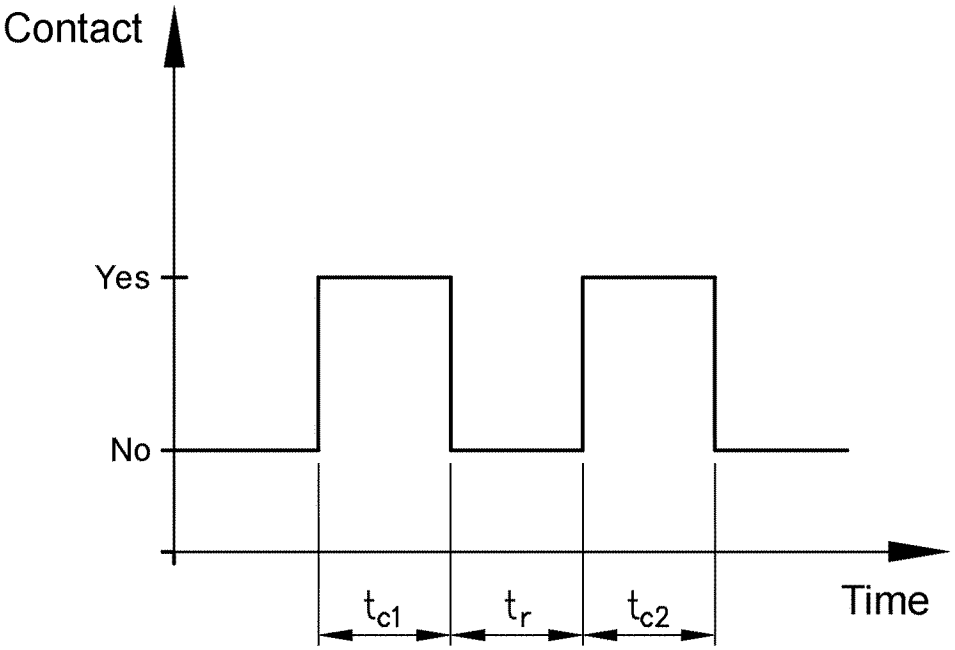
FIG. 7 schematically illustrates a procedure that can be carried out by an embodiment of the control unit according to the first aspect of the present invention, and FIG. 8 schematically illustrates a procedure that can be carried out by an embodiment of the control unit according to the first aspect of the present invention.

FIG. 7 illustrates a further implementation wherein the control unit 28 is adapted to distinguish between an implement single tap and an implement double tap. In FIG. 7, as for the FIG. 6 implementation, the control unit 28 firstly determines whether the contact time tc1 for a first implement contact is within a predetermined tap time range. Moreover, with reference to FIG. 7, the control unit 28 also is adapted to detect a subsequent second implement contact and to determine a release time tr—during which the implement does not contact the reference surface—between the first and second implements contact occasions. If the release time tr is within a predetermined release time range, the control unit 28 determines that the operator has performed an implement double-tap. If the release time tr is without the predetermined release time range, the control unit 28 determines that the operator has performed an implement single-tap.

In an embodiment of the control unit 28 that is adapted to discriminate between single-taps and double-taps, the control unit 28 may also be adapted to issue an action initiating signal in response to a detected single-tap and to issue a negative response signal in response to a detected double-tap.

Purely by way of example, a single-tap may be interpreted as a positive response (i.e. "yes") and a double-tap may be interpreted as a negative response (i.e. "no") to a question asked to the operator. As another non-limiting example, a single-tap may be interpreted as a negative response (i.e. "no") and a double-tap may be interpreted as a positive response (i.e. "yes").

The action initiating signal may comprise a request to the control entity 32 to determine the current position of the implement 14. To this end, the working machine 10 may comprise position determining means 38 adapted to determine at least the vertical position of the implement 14. As a non-limiting example, such a vertical position may be determined using information indicative of the current condition, e.g. stroke, of each one of the previously discussed actuators 22, 24, 26.

However, it is also envisaged that implementations of the position determining means 38 in addition and/or instead may determine the relative angles between the components, e.g. the the main body 12, the boom 18, the arm 20 and the implement 14, of the working machine 10. Such an implementation of the position determining means may comprise one of more angle gauges or sensors (not shown) adapted to determine the relative angle between at least two components of the connector 16. As a further alternative, the position determining means may instead, or in addition to any one of the above discussed implementations, comprise one or more inclinometer or a more advanced gauge of similar type.

The position determining means 38 may also or instead be adapted to determine the horizontal position of the implement 14. Such a horizontal position may be determined relative to e.g. a portion of the working machine 10, such as the propulsion unit 17, or in global coordinates. As for the vertical position, the horizontal position may also be determined using information indicative of the current condition, e.g. stroke, of each one of the previously discussed actuators 22, 24, 26. Moreover, for a working machine such as the one illustrated in FIG. 1 in which the main portion 12 is pivotable relative to the propulsion unit 17, the position of the main portion 12 relative to the propulsion unit 17 may also be used for determining the current horizontal position of the implement 14.

Purely by way of example, and as is illustrated in FIG. 1, the position determining means 38 may be a separate unit in the working machine 10. As another non-limiting example, the position determining means 38 may form part of another unit of the working machine, such as the control unit 28 or the control entity 32.

Additionally, the embodiment of the working machine 10 illustrated in FIG. 1 comprises a global navigation satellite system 34 adapted to determine the position of the working machine 10. A non-exhaustive list of global navigation satellite systems includes: GPS, GLONASS, Galileo or Beidou. Purely by way of example, instead of, or in addition to, a global navigation satellite system, embodiments of the working machine 10 may comprise another type of assembly for determining the position, e.g. the horizontal position, of the working machine 10, e.g. a Total Station (TS), alternatively an Automatic Total Station (ATS).

Figure 8:
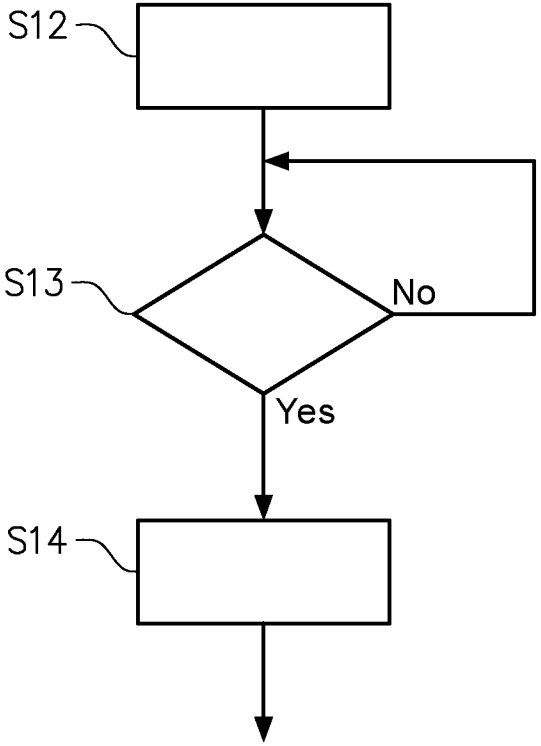
Figure 8:
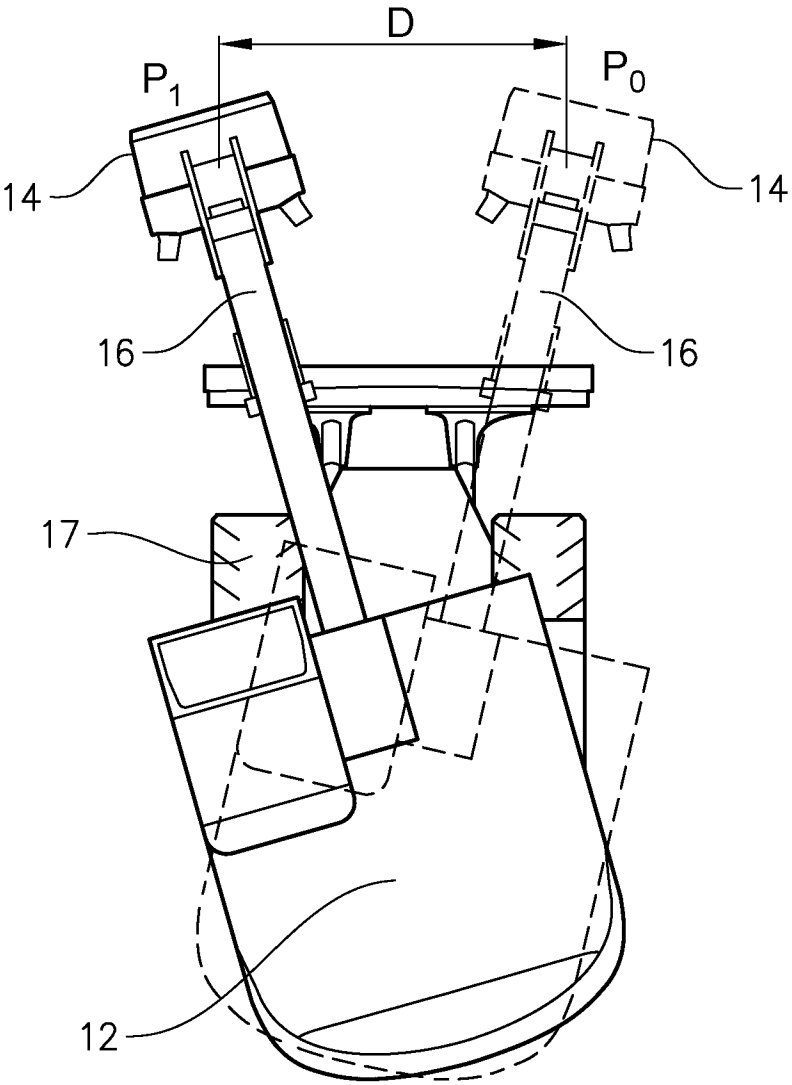

Irrespective of how the position of the implement 14 is determined, with reference to FIG. 8, the control unit 28 may be adapted to operate in accordance with the following.

In a first step S12 the control unit 28 is instructed to stand-by for an implement position determination assignment. Thereafter, in Step S13, the control unit 28 determines that the implement 14 contacts the reference surface 34. In the event that contact with the reference surface is confirmed, the control unit 28 proceeds to step S14 in which the current position P1 of the implement 14 is determined. The current position P1 may relate to the vertical and/or horizontal position of the implement 14 and may for instance be determined in accordance with any one of the above proposed position determining implementations.

Once the current position P1 is determined, the control unit 28 may store the thus determined position and/or use the current position P1 for further analysis. For instance, and with reference to FIG. 8, the current position P1 may be used for determining the distance D between the current position P1 and a previously stored reference position P0 of the implement 14. In other words, the control unit 28 may be adapted to issue an action initiating signal comprising a request to the control entity 32 to determine the distance D between the current position P1 and a previously stored reference position P0 of the implement 14.

It is to be understood that the present invention is not limited to the embodiments described above and illustrated in the drawings; rather, the skilled person will recognize that many changes and modifications may be made.

The invention claimed is:

1. A control unit for a working machine, the working machine comprising an implement and a main body, the implement being movable relative to the main body, the working machine further comprising a control entity adapted to be activated upon receipt of an action initiating signal, wherein the control unit is adapted to:

identify that a human operator of the working machine actively operates the implement relative to the main body towards a reference surface until the implement contacts the reference surface, thereby identifying a human operator input signal; and upon identification of the operator input signal, issue the action initiating signal to the control entity, wherein the working machine comprises a contact detecting arrangement for determining that the implement contacts the reference surface, the control unit being adapted to receive a contact signal from the contact detecting arrangement indicative of that the implement contacts the reference surface, wherein the contact detecting arrangement comprises a force determining means adapted to determine a force applied to the implement, the control unit being adapted to:

determine a contact force value indicative of a contact force between the reference surface and the implement using the force determining means; and determine that the implement contacts the reference surface for a contact force value being within a predetermined contact force value range.

2. The control unit according to claim 1, wherein the control unit is adapted to receive a confirmation request, the confirmation request preferably being a question asked to the operator of the working machine, the control unit being adapted to issue the action initiating signal upon identification of an affirmative operator input signal as a response to the confirmation request.

3. The control unit according to claim 1, wherein the control unit is further adapted to identify that a human operator of the working machine, subsequent to an established contact between the implement and the reference surface, actively operates the implement away from the reference surface such that the contact between the implement and the reference surface ceases.

4. The control unit according to claim 3, wherein the control unit is adapted to determine a contact time (tc) during which the implement contacts the reference surface before the contact ceases.

5. The control unit according to claim 4, wherein the control unit is adapted to issue the action initiating signal to the control entity only if the contact time (tc) is within a predetermined tap time range.

6. The control unit according to claim 1, wherein the action initiating signal comprises a request to the control entity to determine a current position of the implement.

7. The control unit according to claim 6, wherein the action initiating signal comprises a request to the control entity to determine a distance (D) between the current position and a previously stored reference position of the implement.

8. A control system for a working machine, the control system comprising a control unit according to claim 1 and a control entity, the control unit being adapted to communicate with the control entity.

9. A working machine comprising a control unit according to claim 1.

10. A method for issuing an action initiating signal to a control entity of a working machine, the working machine comprising an implement and a main body, the implement being movable relative to the main body, the control entity being adapted to be activated upon receipt of the action initiating signal, comprising:

identifying that a human operator of the working machine actively operates the implement relative to the main body towards a reference surface until the implement contacts the reference surface, thereby identifying the operator input signal; and upon identification of the operator input signal, issuing the action initiating signal to the control entity, wherein the working machine comprises a contact detecting arrangement for determining that the implement contacts the reference surface, the method comprises receiving a contact signal from the contact detecting arrangement indicative of that the implement contacts the reference surface, and wherein the contact detecting arrangement comprises a force determining means adapted to determine a force applied to the implement, comprising:

determining a contact force value indicative of a contact force between the reference surface and the implement using the force determining means; and determining that the implement contacts the reference surface for a contact force value being within a predetermined contact force value range.

11. The method according to claim 10, wherein the method further comprises receiving a confirmation request, the confirmation request preferably being a question asked to the operator of the working machine, the method comprising issuing the action initiating signal upon identification of an affirmative operator input signal as a response to the confirmation request.

12. The method according to according to claim 10, wherein the method further comprises identifying that a human operator of the working machine, subsequent to an established contact between the implement and the reference surface, actively operates the implement away from the reference surface such that the contact ceases.

13. The method according to according to claim 12, wherein the method further comprises determining a contact time (tc) during which the implement contacts the reference surface before the contact ceases.

14. The method according to claim 13, wherein the method comprises issuing the action initiating signal to the control entity if the contact time (tc) is within a predetermined tap time range.

15. The method according to claim 10, wherein the method further comprises determining a current position of the implement, the action initiating signal comprises a request to the control entity to store the current position of the implement.

16. The method according to claim 15, wherein the action initiating signal comprises a request to the control entity to determine the distance between the current position and a previously stored reference position of the implement.

17. A control unit for a working machine, the working machine comprising an implement and a main body, the implement being movable relative to the main body, the working machine further comprising a control entity adapted to be activated upon receipt of an action initiating signal, wherein the control unit is adapted to:

identify that a human operator of the working machine actively operates the implement relative to the main body towards a reference surface until the implement contacts the reference surface, thereby identifying a human operator input signal; and upon identification of the operator input signal, issue the action initiating signal to the control entity, wherein the control unit is further adapted to identify that a human operator of the working machine, subsequent to an established contact between the implement and the reference surface, actively operates the implement away from the reference surface such that the contact between the implement and the reference surface ceases, and wherein the control unit is adapted to determine a contact time (tc) during which the implement contacts the reference surface before the contact ceases.

18. A method for issuing an action initiating signal to a control entity of a working machine, the working machine comprising an implement and a main body, the implement being movable relative to the main body, the control entity being adapted to be activated upon receipt of the action initiating signal, comprising:

identifying that a human operator of the working machine actively operates the implement relative to the main body towards a reference surface until the implement contacts the reference surface, thereby identifying the operator input signal; and upon identification of the operator input signal, issuing the action initiating signal to the control entity, wherein the method further comprises identifying that a human operator of the working machine, subsequent to an established contact between the implement and the reference surface, actively operates the implement away from the reference surface such that the contact ceases, and wherein the method further comprises determining a contact time (tc) during which the implement contacts the reference surface before the contact ceases.

* * * * *